US006685604B1

(12) United States Patent
Muscocea

(10) Patent No.: US 6,685,604 B1
(45) Date of Patent: Feb. 3, 2004

(54) MUSCLE-BUILDING APPARATUS FOR PRESS-UPS

(76) Inventor: Anghel Muscocea, 168, Boulevard, Saint-Germain, F-75006 Paris (FR)

( * ) Notice: Subject to any disclaimer, the term of this patent is extended or adjusted under 35 U.S.C. 154(b) by 0 days.

(21) Appl. No.: 10/069,966

(22) PCT Filed: Sep. 6, 2000

(86) PCT No.: PCT/FR00/02445

§ 371 (c)(1),
(2), (4) Date: May 8, 2002

(87) PCT Pub. No.: WO01/17615

PCT Pub. Date: Mar. 15, 2001

(30) Foreign Application Priority Data

Sep. 9, 1999 (FR) ..... 99 11261

(51) Int. Cl.[7] ..... A63B 21/00

(52) U.S. Cl. ..... 482/141; 482/96; 482/95

(58) Field of Search ..... 482/141, 92, 133, 482/95, 97, 114, 93, 140, 144, 96

(56) References Cited

U.S. PATENT DOCUMENTS 5,330,408 A 7/1994 Westmoreland, Jr.
5,531,658 A 7/1996 L. S. C.

*Primary Examiner*—Jerome W. Donnelly
(74) *Attorney, Agent, or Firm*—Greenblum & Bernstein, P.L.C.

(57) ABSTRACT

Muscle-building apparatus for press-ups includes a bearing plate having a cushion. A frame includes first and second vertical posts. A first arm has a handle end and a journal end. A first handle is arranged on the handle end of the first arm. A second arm has a handle end and a journal end. A second handle is arranged on the handle end of the second arm. The first arm is movably mounted to the first vertical post between the handle end and the journal end. The second arm is movably mounted to the second vertical post between the handle end and the journal end. A first leg connects the journal end of the first arm to the bearing plate. The first leg is movably mounted to each of the first arm and the bearing plate. A second leg connects the journal end of the second arm to the bearing plate. The second leg is movably mounted to each of the second arm and the bearing plate. Movement of the first and second arms causes movement of the bearing plate.

23 Claims, 2 Drawing Sheets

MUSCLE-BUILDING APPARATUS FOR PRESS-UPS

CROSS-REFERENCE TO RELATED APPLICATIONS

The present application is a National Stage Application of International Application No. PCT/FR00/02445, filed Sep. 6, 2000. Further, the present application claims priority under 35 U.S.C. §119 of French Patent Application No. 99/11261 filed on Sep. 9, 1999.

BACKGROUND OF THE INVENTION

1. Field of the Invention

The present invention relates to a muscle-building apparatus for press-ups.

2. Discussion of Background Information

One knows how difficult it is to do press-ups due to inadequate positioning and lack of strength, etc.

In muscle building, the problem to solve, when doing press-ups, consists of performing the exercise more easily, and in a correct position, without much exertion.

SUMMARY OF THE INVENTION

The present invention, which remedies this drawback, relates to a body-building apparatus for performing the exercise referred to as press-ups, which is made up of a frame resting on the floor, having two vertical posts supporting two journaled movable arms, with handles fixed at the end of the arms, then linked via two movable legs connected to a bearing plate supporting a cushion.

According to another characteristic of the invention, the arms journaled on the vertical posts of the frame are pushed downward by the handles, creating a lever for the plate by raising and lowering it, while performing the exercise referred to as press-ups.

The invention also provides for a muscle-building apparatus for press-ups, wherein the apparatus comprises a bearing plate that includes a cushion. A frame comprises first and second vertical posts. A first arm comprises a handle end and a journal end. A first handle is arranged on the handle end of the first armn. A second arm comprises a handle end and a journal end. A second handle is arranged on the handle end of the second arm. The first arm is movably mounted to the first vertical post between the handle end and the journal end. The second arm is movably mounted to the second vertical post between the handle end and the journal end. A first leg connects the journal end of the first arm to the bearing plate. The first leg is movably mounted to each of the first arm and the bearing plate. A second leg connects the journal end of the second arm to the bearing plate. The second leg is movably mounted to each of the second arm and the bearing plate. Movement of the first and second arms causes movement of the bearing plate.

The muscle-building apparatus may further comprise a first connecting journal movably coupling the first arm to the first vertical post, a second connecting journal movably coupling the second arm to the second vertical post, two third connecting journals movably coupling the first leg to each of the first arm and the bearing plate, and two fourth connecting journals movably coupling the second leg to each of the second arm and the bearing plate. The bearing plate may move upwardly when the first and second arms are moved downwardly, and may move downwardly when the first and second arms are moved upwardly. The first and second handles may be movable to a position wherein they are perpendicular to an axis running through a planar base portion of the frame and the bearing plate, whereby the first and second handles enable a perfect position of a user's body so as to provide good muscular amplitude.

The muscle-building apparatus may further comprise a guide mechanism which opposes tilting of the bearing plate. The guide mechanism may be coupled to each of the frame and the bearing plate. The guide mechanism may comprise blades which are linked by articulations and which can collapse on one another during a downward movement of the bearing plate. The guide mechanism may oppose left or right side tilting of the bearing plate. The bearing plate may support the cushion. The first and second handles mat each comprise an upper handle member and at least one side handle member, the upper handle members being oriented parallel to the first and second arms and the at least one side handle members being oriented perpendicular to the first and second arms. The first and second handles may each comprise an upper handle member and side handle members, the upper handle members being oriented parallel to the first and second arms and the side handle members being oriented perpendicular to the first and second arms.

The invention also provides for a muscle-building apparatus for press-ups, wherein the apparatus comprises a support comprising a cushion. A frame comprises first and second vertical posts. A first arm comprises a handle end and a journal end. A first handle is arranged on the handle end of the first arm. A second arm comprises a handle end and a journal end. A second handle is arranged on the handle end of the second arm. The first arm is pivotally mounted to the first vertical post between the handle end and the journal end. The second arm is pivotally mounted to the second vertical post between the handle end and the journal end. A first leg comprises ends which are movably connected to each of the support and the journal end of the first arm. A second leg comprises ends which are movably connected to each of the support and the journal end of the second arm. Pivoting movement of the first and second arms causes vertical movement of the support.

The muscle-building apparatus may further comprise a first connecting journal movably coupling the first arm to the first vertical post, a second connecting journal movably coupling the second arm to the second vertical post, two third connecting journals movably coupling the first leg to each of the first arm and the support, and two fourth connecting journals movably coupling the second leg to each of the second arm and the support. The support may move upwardly when the first and second arms are pivoted downwardly, and wherein the support moves downwardly when the first and second arms are pivoted upwardly. The first and second handles may be movable to a position wherein they are perpendicular to an axis running through a planar base portion of the frame and the support, whereby the first and second handles enable a perfect position of a user's body so as to provide good muscular amplitude.

The muscle-building apparatus may further comprise a guide mechanism which opposes tilting of the support. The guide mechanism may be coupled to each of the frame and the support. The guide mechanism may comprise blades which are linked by articulations and which can collapse on one another during a downward movement of the support. The guide mechanism may oppose left or right side tilting of the support. The support may support the cushion. The first and second handles may each comprise an upper handle member and at least one side handle member, the upper handle members being oriented parallel to the first and second arms and the at least one side handle members being oriented perpendicular to the first and second arms. The first and second handles may each comprise an upper handle member and side handle members, the upper handle members being oriented parallel to the first and second arms and the side handle members being oriented perpendicular to the first and second arms.

The invention also provides for a muscle-building apparatus for press-ups, wherein the apparatus comprises a support plate. A frame comprises a base and first and second vertical posts. A first arm comprises a handle end and a journal end. A first handle is arranged on the handle end of the first arm. A second arm comprises a handle end and a journal end. A second handle is arranged on the handle end of the second arm. The first arm is movably mounted to the first vertical post between the handle end and the journal end. The second arm is movably mounted to the second vertical post between the handle end and the journal end. A first leg connects the journal end of the first arm to the support plate. The first leg is movably mounted to each of the first arm and the support plate. A second leg connects the journal end of the second arm to the support plate. The second leg is movably mounted to each of the second arm and the support plate. A guide mechanism opposes tilting of the support plate. The first and second arms are arranged on opposite sides of the support plate. Movement of the first and second arms relative to the first and second posts causes movement of the support plate relative to the frame.

BRIEF DESCRIPTION OF THE DRAWINGS

Other characteristics will become more apparent from the description that follows, with reference to the annexed drawings, provided for guidance only, in which.

DETAILED DESCRIPTION OF THE INVENTION

Figure 1:
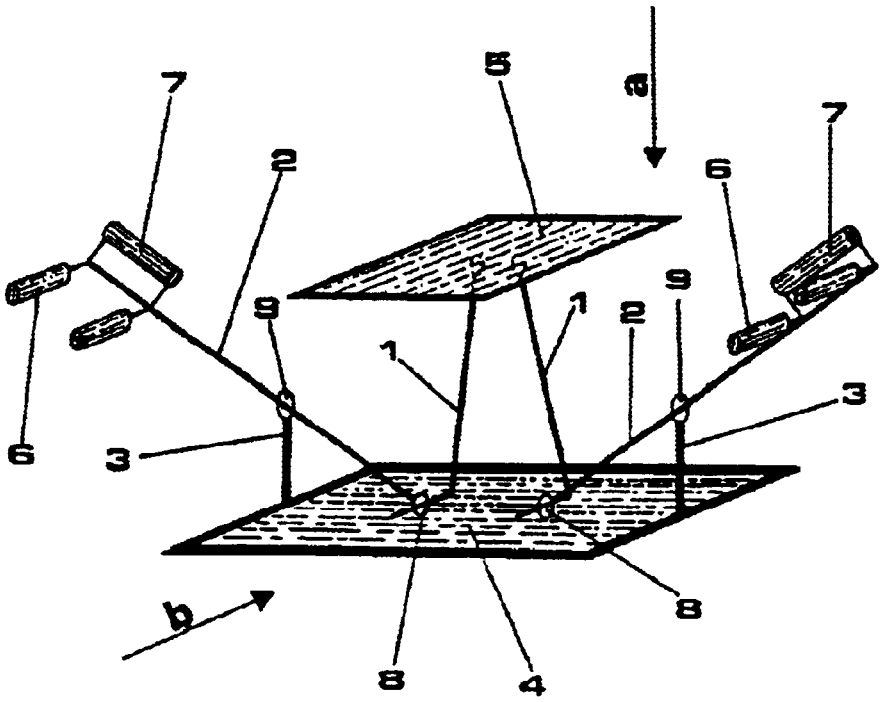
FIG. 1 is a perspective schematic view showing the apparatus of the invention.
Figure 2:
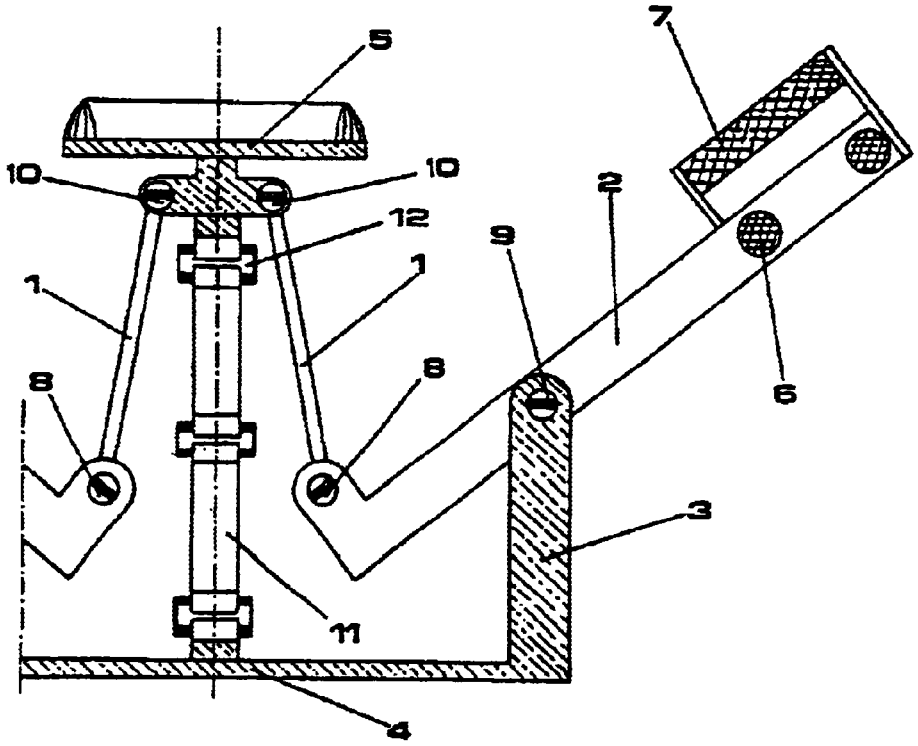
FIG. 2 is an enlarged view, along the arrow B of FIG. 1.
Figure 3:
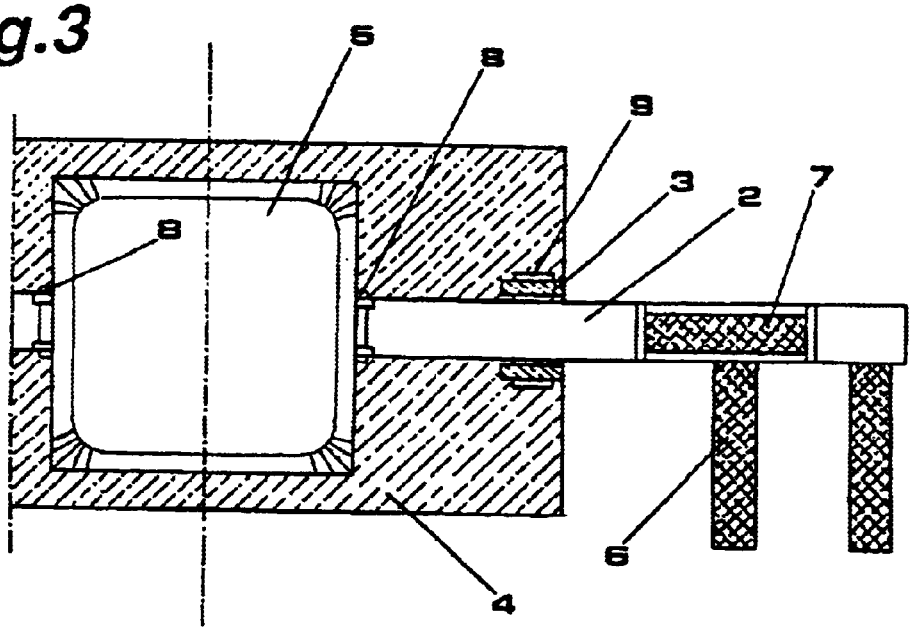
FIG. 3 is an enlarged view, along the arrow A of FIG. 1.

Referring to the drawing and according to one embodiment, one sees that the apparatus is made of a frame 4 resting on the floor, having two vertical posts 3 supporting two joumaled 9 movable arms 2, with handles 6 and 7 fixed in the ends on the arms, then linked, via the two movable legs 1 and by their journals 8 and 10, to a bearing plate 5 supporting a cushion.

According to the invention, the two arms 2 joumaled 9 on the vertical posts of the frame 4 are pushed downward by the handles 6 and 7, with the hands, creating a lever for the plate 5 by raising and lowering it, while performing the exercise referred to as press-ups.

It must be noted that the handles 6 and 7 fixed in the end of the movable arms 2, positioned perpendicular and parallel to the apparatus, enable a perfect position of the body by providing it with a good muscular amplitude.

According to another characteristic of the invention, the plate 5 comprises a guide opposing its left or right tilting, fixed on the frame 4, which is made up of blades 11 linked by their journal 12, collapsing on one another, along the downward movement of the plate.

The invention also provides for a muscle-building apparatus for press-ups, wherein the apparatus comprises a bearing plate 5 that includes a cushion. A frame 4 comprises first and second vertical posts 3. A first arm 2 comprises a handle end and a journal end. A first handle 6/7 is arranged on the handle end of the first arm 2. A second arm 2 comprises a handle end and a journal end. A second handle 6/7 is arranged on the handle end of the second arm 2. The first arm 2 is movably mounted to the first vertical post 3 between the handle end and the journal end. The second arm 2 is movably mounted to the second vertical post 3 between the handle end and the journal end. A first leg 1 connects the journal end of the first arm 2 to the bearing plate 5. The first leg 1 is movably mounted to each of the first arm 2 and the bearing plate 5. A second leg 1 connects the journal end of the second arm 2 to the bearing plate 5. The second leg 1 is movably mounted to each of the second arm 2 and the bearing plate 5. Movement of the first and second arms causes movement of the bearing plate.

The muscle-building apparatus further includes a first connecting journal 9 that movably couples the first arm 2 to the first vertical post 3, a second connecting journal 9 movably couples the second arm 2 to the second vertical post 3, two third connecting journals 8, 10 movably couple the first leg 1 to each of the first arm 2 and the bearing plate 5, and two fourth connecting journals 8, 10 movably couple the second leg 1 to each of the second arm 2 and the bearing plate 5. The bearing plate 5 may move upwardly when the first and second arms are moved downwardly, and may move downwardly when the first and second arms are moved upwardly. The first and second handles 6/7 may be movable to a position wherein they are perpendicular to an axis running through a planar base portion of the frame and the bearing plate, whereby the first and second handles 6/7 enable a perfect position of a user's body so as to provide good muscular amplitude.

The muscle-building apparatus also includes a guide mechanism 11/12 which opposes tilting of the bearing plate 5. The guide mechanism 11/12 is coupled to each of the frame 4 and the bearing plate 5. The guide mechanism comprises blades 11 which are linked by articulations 12 and which can collapse on one another during a downward movement of the bearing plate 5. The guide mechanism opposes left or right side tilting of the bearing plate 5. The bearing plate 5 supports the cushion. The first and second handles 6/7 each comprise an upper handle member 7 and at least one side handle member 6, the upper handle members 7 are oriented parallel to the first and second arms 2 and the at least one side handle members 6 are oriented perpendicular to the first and second arms 2. The first and second handles 6/7 may each comprise an upper handle member 7 and side handle members 5, the upper handle members 7 being oriented parallel to the first and second arms 2 and the side handle members 6 being oriented perpendicular to the first and second arms 2.

What is claimed is:

1. A muscle-building apparatus for press-ups, the apparatus comprising:

a bearing plate comprising a cushion;

a frame comprising first and second vertical posts;

a first arm comprising a handle end and a journal end;

a first handle arranged on the handle end of the first armn;

a second arm comprising a handle end and a journal end;

a second handle arranged on the handle end of the second arm;

the first arm being movably mounted to the first vertical post between the handle end and the journal end;

the second arm being movably mounted to the second vertical post between the handle end and the journal end;

a first leg connecting the journal end of the first arm to the bearing plate;

the first leg being movably mounted to each of the first arm and the bearing plate;

a second leg connecting the journal end of the second arm to the bearing plate; and the second leg being movably mounted to each of the second arm and the bearing plate, wherein movement of the first and second arms causes movement of the bearing plate.

2. The muscle-building apparatus of claim 1, further comprising:

a first connecting journal movably coupling the first arm to the first vertical post;

a second connecting journal movably coupling the second arm to the second vertical post;

two third connecting journals movably coupling the first leg to each of the first arm and the bearing plate; and two fourth connecting journals movably coupling the second leg to each of the second arm and the bearing plate.

3. The muscle-building apparatus of claim 1, wherein the bearing plate moves upwardly when the first and second arms are moved downwardly, and wherein the bearing plate moves downwardly when the first and second arms are moved upwardly.

4. The muscle-building apparatus of claim 1, wherein the first and second handles are movable to a position wherein they are perpendicular to an axis running through a planar base portion of the frame and the bearing plate, whereby the first and second handles enable a perfect position of a user's body so as to provide good muscular amplitude.

5. The muscle-building apparatus of claim 1, further comprising a guide mechanism which opposes tilting of the bearing plate.

6. The muscle-building apparatus of claim 5, wherein the guide mechanism is coupled to each of the frame and the bearing plate.

7. The muscle-building apparatus of claim 6, wherein the guide mechanism comprises blades which are linked by articulations and which can collapse on one another during a downward movement of the bearing plate.

8. The muscle-building apparatus of claim 5, wherein the guide mechanism opposes left or right side tilting of the bearing plate.

9. The muscle-building apparatus of claim 1, wherein the bearing plate supports the cushion.

10. The muscle-building apparatus of claim 1, wherein the first and second handles each comprise an upper handle member and at least one side handle member, the upper handle members being oriented parallel to the first and second arms and the at least one side handle members being oriented perpendicular to the first and second arms.

11. The muscle-building apparatus of claim 1, wherein the first and second handles each comprise an upper handle member and side handle members, the upper handle members being oriented parallel to the first and second arms and the side handle members being oriented perpendicular to the first and second arms.

12. A muscle-building apparatus for press-ups, the apparatus comprising:

a support comprising a cushion;

a frame comprising first and second vertical posts;

a first arm comprising a handle end and a journal end;

a first handle arranged on the handle end of the first arm;

a second arm comprising a handle end and a journal end;

a second handle arranged on the handle end of the second arm;

the first arm being pivotally mounted to the first vertical post between the handle end and the journal end;

the second arm being pivotally mounted to the second vertical post between the handle end and the journal end;

a first leg comprising ends which are movably connected to each of the support and the journal end of the first arm;

a second leg comprising ends which are movably connected to each of the support and the journal end of the second arm, wherein pivoting movement of the first and second arms causes vertical movement of the support.

13. The muscle-building apparatus of claim 12, further comprising:

a first connecting journal movably coupling the first arm to the first vertical post;

a second connecting journal movably coupling the second arm to the second vertical post;

two third connecting journals movably coupling the first leg to each of the first arm and the support; and two fourth connecting journals movably coupling the second leg to each of the second arm and the support.

14. The muscle-building apparatus of claim 12, wherein the support moves upwardly when the first and second arms are pivoted downwardly, and wherein the support moves downwardly when the first and second arms are pivoted upwardly.

15. The muscle-building apparatus of claim 12, wherein the first and second handles are movable to a position wherein they are perpendicular to an axis running through a planar base portion of the frame and the support, whereby the first and second handles enable a perfect position of a user's body so as to provide good muscular amplitude.

16. The muscle-building apparatus of claim 12, further comprising a guide mechanism which opposes tilting of the support.

17. The muscle-building apparatus of claim 16, wherein the guide mechanism is coupled to each of the frame and the support.

18. The muscle-building apparatus of claim 17, wherein the guide mechanism comprises blades which are linked by articulations and which can collapse on one another during a downward movement of the support.

19. The muscle-building apparatus of claim 16, wherein the guide mechanism opposes left or right side tilting of the support.

20. The muscle-building apparatus of claim 12, wherein the support supports the cushion.

21. The muscle-building apparatus of claim 12, wherein the first and second handles each comprise an upper handle member and at least one side handle member, the upper handle members being oriented parallel to the first and second arms and the at least one side handle members being oriented perpendicular to the first and second arms.

22. The muscle-building apparatus of claim 12, wherein the first and second handles each comprise an upper handle member and side handle members, the upper handle members being oriented parallel to the first and second arms and the side handle members being oriented perpendicular to the first and second arms.

23. A muscle-building apparatus for press-ups, the apparatus comprising:

a support plate;

a frame comprising a base and first and second vertical posts;

a first arm comprising a handle end and a journal end;

a first handle arranged on the handle end of the first arm;

a second arm comprising a handle end and a journal end;

a second handle arranged on the handle end of the second arm;

the first arm being movably mounted to the first vertical post between the handle end and the journal end;

the second arm being movably mounted to the second vertical post between the handle end and the journal end;

a first leg connecting the journal end of the first arm to the support plate;

the first leg being movably mounted to each of the first arm and the support plate;

a second leg connecting the journal end of the second arm to the support plate;

the second leg being movably mounted to each of the second arm and the support plate; and a guide mechanism which opposes tilting of the support plate, wherein the first and second arms are arranged on opposite sides of the support plate, and wherein movement of the first and second arms relative to the first and second vertical posts causes movement of the support plate relative to the frame.

* * * * *